343-700 MS AU 251 EX
2/17/87 OR 4,644,361

United States Patent [19]

Yokoyama

[11] Patent Number: 4,644,361

[45] Date of Patent: Feb. 17, 1987

[54] COMBINATION MICROSTRIP AND UNIPOLE ANTENNA

[75] Inventor: Yukio Yokoyama, Tokyo, Japan

[73] Assignee: NEC Corporation, Japan

[21] Appl. No.: 734,686

[22] Filed: May 16, 1985

[30] Foreign Application Priority Data

May 18, 1984 [JP] Japan ..... 59-99919

[51] Int. Cl.[4] ..... H01Q 1/38

[52] U.S. Cl. ..... 343/700 MS; 343/725; 343/900

[58] Field of Search ..... 343/700 MS File, 705, 343/725, 728, 729, 700, 751, 767, 768, 900, 706, 708–713

[56] References Cited

U.S. PATENT DOCUMENTS 4,443,802 4/1984 Mayes ..... 343/729
4,587,524 5/1986 Hall ..... 343/729

*Primary Examiner*—Marvin L. Nussbaum
*Attorney, Agent, or Firm*—Ostrolenk, Faber, Gerb & Soffen

[57] ABSTRACT

Unidirectivity is achieved in an antenna including a microstrip portion and a unipole portion. The microstrip portion includes a ground plane conductor, a radiation plane conductor dielectrically spaced from the ground plane conductor, and a conductive member connecting the radiation plane conductor to the ground plane conductor., The unipole portion of the antenna comprises a unipole coupled to the radiation plane conductor. The radiation fields of the microstrip and unipole portions intensify each other in a single direction to achieve unidirectivity.

9 Claims, 10 Drawing Figures

COMBINATION MICROSTRIP AND UNIPOLE ANTENNA

BACKGROUND OF THE INVENTION

This invention relates to a microstrip antenna and more particularly to a microstrip antenna including a unipole antenna for enhanced directivity.

Conventionally, microstrip antennas of compact and thin construction have been used inside of an automobile. Such a microstrip antenna is generally placed on the rear side of the back seat in view of availability in space and simplicity in mounting. Accordingly, to receive radio waves through the rear window, it is desirable to use an antenna having a strong directivity in the direction of the rear window rather than antennas having other directivities, such as in the direction of a ceiling.

SUMMARY OF THE INVENTION

An object of the present invention is, therefore, to provide a microstrip antenna having a strong unidirectivity.

Another object of the invention is to provide a microstrip antenna which is suitable for installing on a board behind the back seat of an automobile.

Still another object of the invention is to provide a microstrip antenna of the foregoing type which is equipped with a compact unipole antenna.

The foregoing objects are achieved in a combination microstrip-unipole antenna. The microstrip portion of the antenna includes a ground plane conductor, a radiation plane conductor dielectrically spaced from the ground plane conductor, and an conductive interconnection member connecting the radiation plane conductor to the ground plane conductor. The unipole portion of the antenna comprises a unipole coupled to the radiation plane conductor. Means are provided for connecting the combination antenna to an external circuit. Unidirectivity of the antenna is achieved since the radiation fields of the microstrip and unipole portions of the antenna intensify each other in a single direction. An antenna with unidirectivity is thus realized.

The unipole antenna may include a bent portion to achieve overall compactness of the antenna.

BRIEF DESCRIPTION OF THE DRAWINGS

The above and other objects, features and advantages of this invention will become more apparent by the following description in conjunction with the accompanying drawings, wherein.

DETAILED DESCRIPTION OF THE PREFERRED EMBODIMENTS

Figure 1:
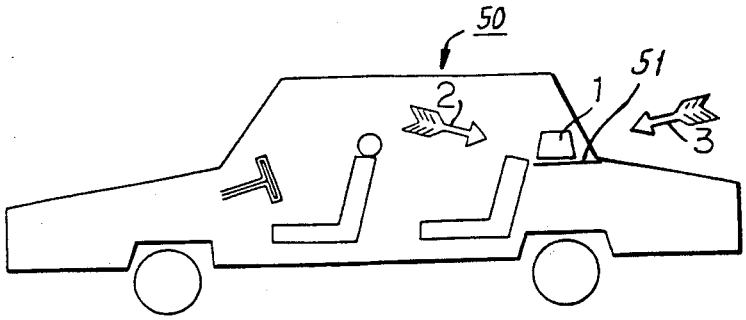
FIG. 1 is a vertical cross section of an automobile having an indoor antenna installed.

Referring to FIG. 1, a microstrip antenna 1 of this invention may be placed on a rear board 51 inside an automobile 50. Radio waves arrive at rear board 51 more from the direction 3 of the rear window than from the direction 2 of the front window. An antenna of a unidirectivity is more desirable for such a location 51, but there has not yet been put into practical use an indoor microstrip antenna having such advantageous characteristics.

Figure 2:
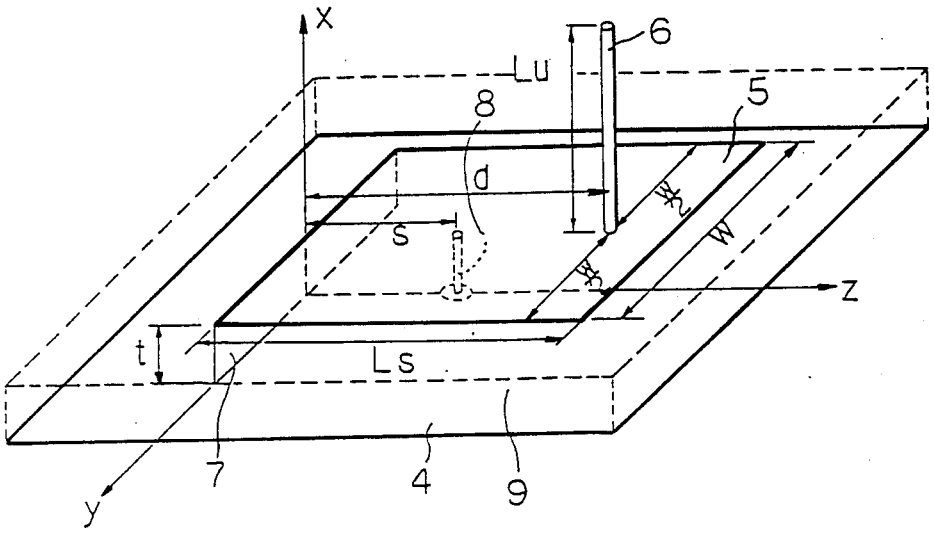
FIG. 2 is a perspective view of a microstrip antenna according to this invention.

FIG. 2 is a schematic view of an embodiment of the antenna according to this invention. This antenna includes a unipole antenna 6 and a microstrip antenna (hereinafter referred to as an "MS" antenna). The MS antenna comprises a ground conductor plane 4 which extends in the y-z plane, a radiating conductor plane 5, a connecting conductor plane 7 connecting the conductor planes 4 and 5, and a dielectric element 9 placed between the conductors 4 and 5.

The length Ls (in the z direction) of the MS antenna (4,5,7,9) is selected to be about $\lambda/4$ ($\lambda=\lambda_o/\sqrt{\epsilon r}$, where $\lambda$ represents a wavelength used; $\lambda_o$, a free space wavelength; and $\epsilon r$, the relative dielectric constant of the substrate 9). The width W (in the y direction) and the thickness t (in the x direction) of the MS antenna are determined depending on the relative bandwidth. The unipole antenna 6 is placed on the radiating conductor plane 5 at a position which is spaced by W/2 from both ends of the radiating conductor plane 5 (in the y direction), i.e. at the symmetry axis, and spaced from the connecting plane conductor 7 by d (in the z direction). A coaxial cable 8 for feeding power is connected at a feeding location S (in the direction z) in a manner to connect the outer conductor thereof to the ground plane conductor 4 and the central conductor to the radiating plane conductor 5, respectively. The location S is selected so that the cable 8 causes no impedance mismatching.

Figure 3A:
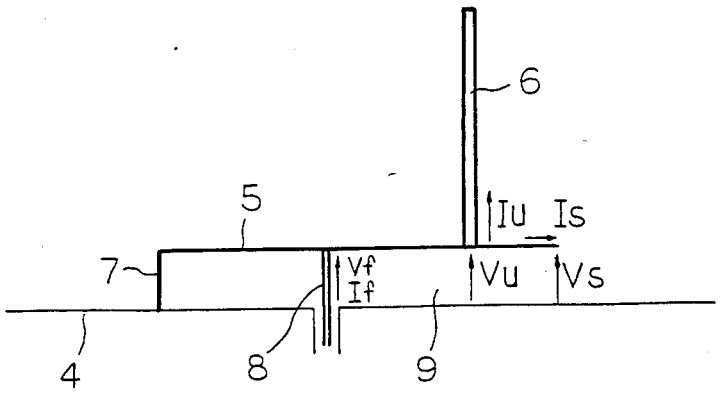
FIGS. 3A and 3B are a vertical cross section and an equivalent circuit diagram, respectively, to explain the antenna shown in FIG. 2.
Figure 3B:
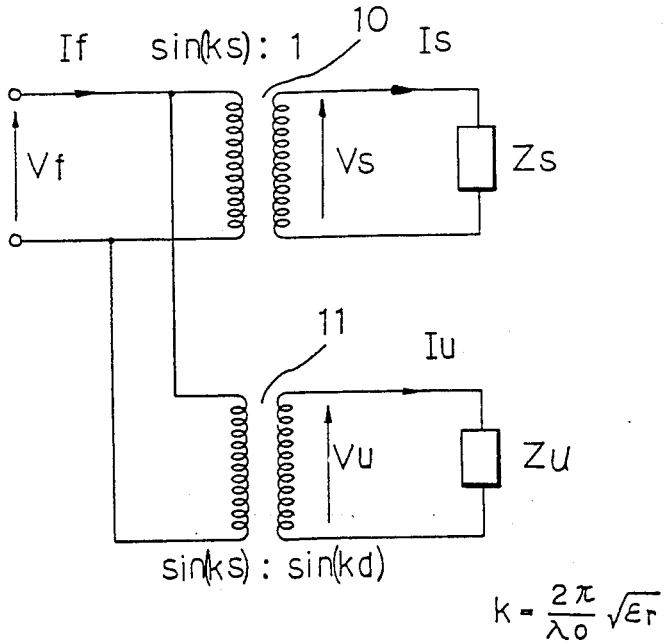

The operation of the combined MS-unipole antenna of this invention may be explained by separating it into a unipole antenna 6 and an MS antenna (4,5,7,9). More particularly, it is assumed in FIG. 3A that the letters Vf, If denote respectively the voltage and the current at the feeding point 8; Vu and Iu, the voltage and the current of the unipole antenna 6; and Vs and Is, the voltage and the current of the MS antenna (4,5,7,9), and that the electric field inside the MS antenna (4,5,7,9) distributes as a sine-wave in length (in the z direction) and uniformly in width (in the y direction). On that assumption, the equivalent circuit of this antenna can be expressed by FIG. 3B using an ideal transformer 10 of turn ratio sin (ks):1 and an ideal transformer 11 of the turn ratio of sin (ks): sin (kd). The terms d and s are depicted in FIG. 2. The constant k is the propagation constant inside the MS antenna (4,5,7,9) and is expressed as $k=2\pi\sqrt{\epsilon r}/\lambda_o$, with $\epsilon r$ and $\lambda_o$ defined above. In FIG. 3B, the letter Zs denotes the impedance of the MS antenna (4,5,7,9); and Zu, the impedance of the unipole antenna 6.

Although there exists mutual coupling between the unipole antenna 6 and the MS antenna (4,5,7,9), the mutual coupling is disregarded in the present description for the sake of simplicity.

Figure 4:
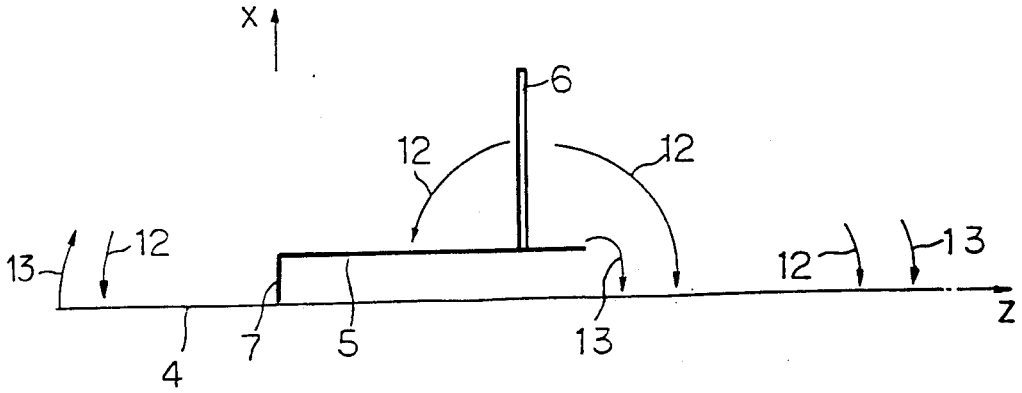
FIG. 4 is a view to explain the radiation field of the antenna shown in FIG. 2.

As schematicent illustrated in FIG. 3B, the unipole antenna 6 and the MS antenna (4,5,7,9) are separately and respectively fed power. The unipole antenna current Iu can be obtained from Vu/Zu. The radiation fields of the unipole antenna 6 and the MS antenna (4,5,7,9) can be obtained from Iu and Vs, and the radiation field of the present MS-unipole antenna can be obtained by summing these radiation fields. If we assume that power is fed at the phase of FIG. 3A and consider the directivity of the MS-unipole antenna qualitatively, we will find that the radiation fields of the unipole antenna 6 and the MS antenna (4,5,7,9) are generated at the phases 12 and 13 in FIG. 4. Therefore, the two radiation fields offset each other in the negative direction on the axis Z, while in the positive direction they intensify each other. The directivity of the MS-unipole antenna thus becomes unidirectional, and the maximum radiation lies in the positive z direction.

In order to effect enhanced unidirectivity in the MS-unipole antenna, it is necessary to effectively make radiation fields of the two antennas offset in the negative z and yet to make them intensified in the positive z. To achieve such purposes, the unipole antenna 6 is positioned mainly at the tip end of the radiating conductor plane 5 ($d \approx Ls$) and the length thereof is determined to be around $\lambda_o/4$ so that the reactance of the unipole antenna 6 becomes substantially zero. Further, the size of the MS antenna (4,5,7,9) is determined so as to make the radiated powers from the MS antenna (4,5,7,9) and the unipole antenna 6 substantially equal.

Figure 5:
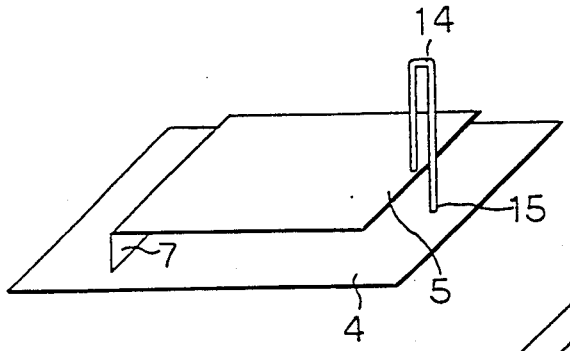
FIGS. 5 through 7 are perspective views of other embodiments of a microstrip antenna according to the present invention.
Figure 6:
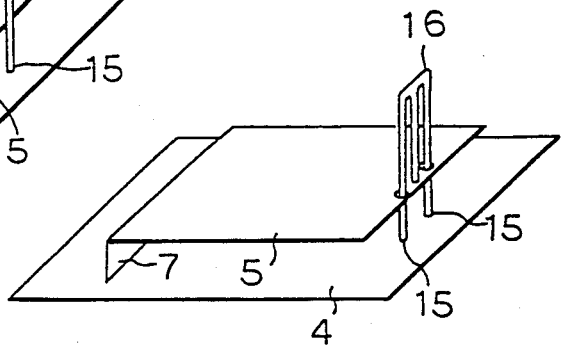

If the necessary bandwidth of the MS antenna (4,5,7,9) is narrow, the MS antenna can be reduced in size by reducing the width W and the thickness t. Since the impedance Zs of such compact MS antenna (4,5,7,9) becomes considerably larger than the impedance Zu of the unipole antenna 6, a desirable unidirectivity characteristic cannot be obtained in the MS-unipole antenna which uses a linear unipole antenna like the one shown in FIG. 2. In such a case, the unipole should be folded as shown in the embodiment shown in FIGS. 5 and 6, so that the impedances Zu of the unipole antenna becomes large enough to provide an enhanced unidirectivity.

Figure 7:
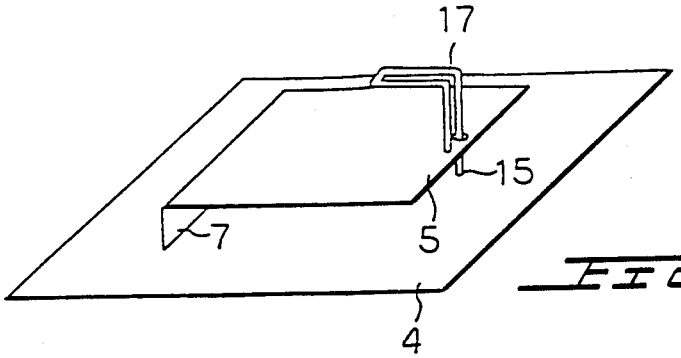

The unipole antenna of the MS-unipole antenna of this invention may be constructed to have a bent tip end and a low height. FIG. 7 shows an embodiment of the MS-unipole antenna using a bent type unipole antenna.

Figure 8A:
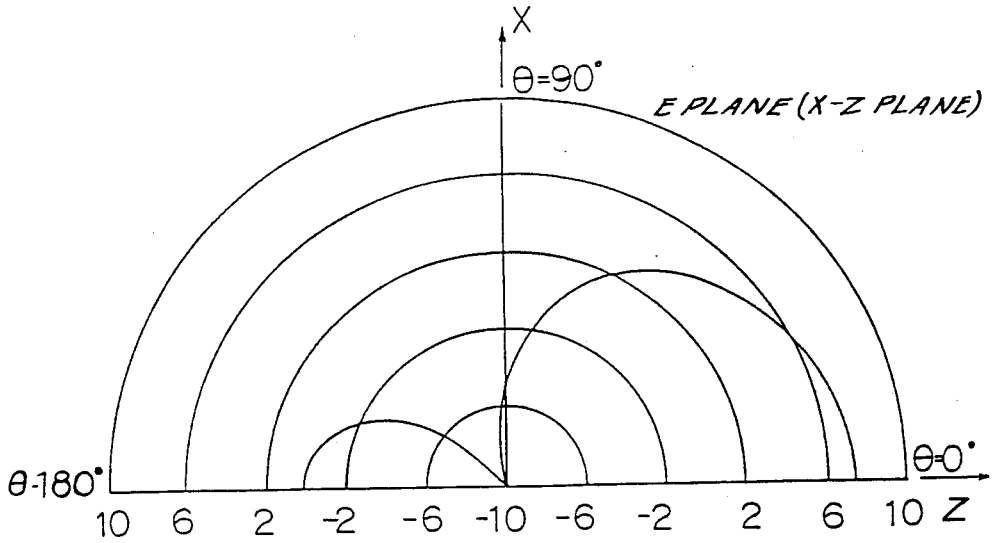
FIGS. 8A and 8B show computed radiation patterns of the antenna shown in FIG. 2.
Figure 8B:
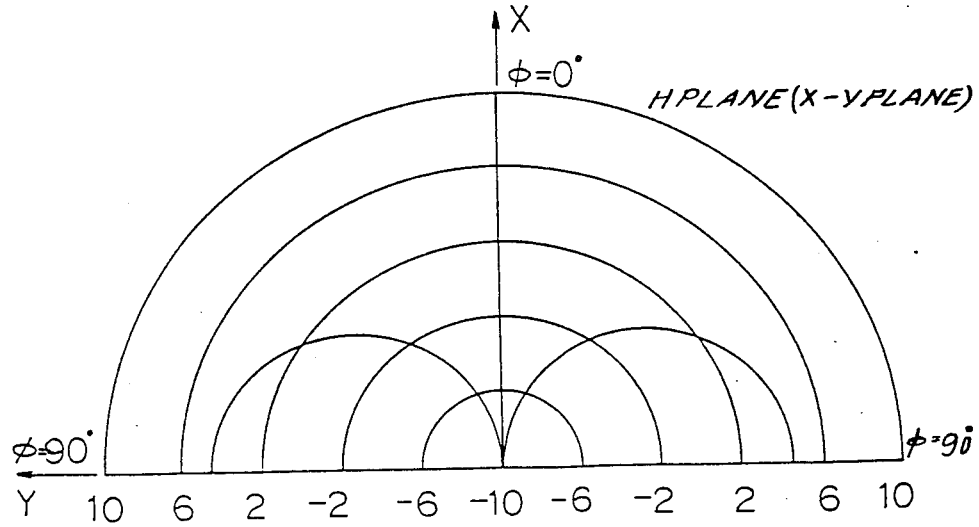

FIGS. 8A and 8B are examples of the gain in directivity of a MS-unipole antenna using a unipole antenna of length about $\lambda_o/4$ when the ground plane conductor is infinity. FIG. 8 illustrates the result of calculation made taking into account the coupling between the unipole antenna and the MS antenna, where $\epsilon r=1$, $t=\lambda_o/30$, $W=\lambda_o/2$, and $D=Ls\approx\lambda_o/4$. As is shown in FIG. 8A, the directivity is oriented to the direction $\theta=0°$ (z axis direction) on the E plane (X-Z plane), and an excellent unidirectivity is obtained.

As described in the foregoing, the MS-unipole antenna can perform as an antenna having unidirectivity simple by selecting an appropriate size. When the necessary bandwidth is narrow, the width and the thickness of the MS antenna can be reduced. The unipole antenna may have a height of less than $\lambda_o/4$ by bending the tip end and making the structure in inverted L-shape. The MS-unipole antenna according to this invention can therefore be made compact enough to be conveniently used in a space-restricted area, such as in an automobile.

What is claimed is:

1. A combination microstrip-unipole antenna, comprising:

(a) a microstrip antenna portion having a ground plane conductor, a radiation plane conductor dielectrically spaced from said ground plane conductor, and a conductive member connecting said radiation plane conductor to said ground plane conductor;

(b) a unipole antenna portion coupled to said radiation plane conductor; and (c) means for connecting said combination antenna to an external circuit.

2. The combination antenna of claim 1, wherein said microstrip antenna portion is proportioned relative to said unipole antenna portion in such a way as to make approximately equal the radiated power from said microstrip and unipole antenna portions.

3. The combination antenna of claim 1, wherein said radiation plane conductor comprises four side edges generally defining a parallelogram, one of said edges contacting said conductive member, and a pair of opposing edges extending away from said conductive member, said single antenna position being positioned on said radiation plane conductor approximately midway between said opposing edges.

4. The combination antenna of claim 3, wherein said unipole antenna portion is coupled to the side of said radiation plane conductor facing away from said ground plane.

5. The combination antenna of claim 1, wherein the length of said unipole antenna is one-quarter of the frequency used by the combination antenna.

6. The combination antenna of claim 1, wherein said unipole antenna includes a bent unipole.

7. The combination antenna of claim 6, wherein said bent unipole is shaped in the form of the letter "L".

8. The combination antenna of claim 1, wherein said connecting means comprises a coaxial cable having an inner conductor and an outer conductor coaxially disposed around said inner conductor, and wherein said inner conductor is connected to said radiation plane conductor and said outer conductor is connected to said ground plane conductor.

9. The combination antenna of claim 1, wherein said conductive member comprises a plane conductor.

* * * * *